US005936349A

United States Patent [19]

Fukai et al.

[11] Patent Number: 5,936,349

[45] Date of Patent: Aug. 10, 1999

[54] ARC TUBE HAVING A PAIR OF MOLYBDENUM FOILS, AND METHOD FOR ITS FABRICATION

[75] Inventors: Kunio Fukai; Nobuo Ohkawai; Masakazu Nagasawa, all of Shizuoka, Japan

[73] Assignee: Koito Manufacturing Co., LTD., Tokyo, Japan

[21] Appl. No.: 08/814,831

[22] Filed: Mar. 11, 1997

[30] Foreign Application Priority Data

Mar. 12, 1996 [JP] Japan ..... 8-083121

[51] Int. Cl.[6] ..... H01J 5/38; H01J 9/32

[52] U.S. Cl. ..... 313/623; 445/43

[58] Field of Search ..... 174/50.64; 445/43, 445/44; 313/623

[56] References Cited

U.S. PATENT DOCUMENTS

| | | | |
|---|---|---|---|
| 2,113,984 | 4/1938 | Harris et al. | 174/50.64 |
| 4,136,298 | 1/1979 | Hansler | 174/50.64 |
| 4,389,201 | 6/1983 | Hansler et al. | 445/26 |
| 4,419,602 | 12/1983 | Mitamura et al. | 313/331 |
| 5,277,639 | 1/1994 | Nagata et al. . | |
| 5,286,227 | 2/1994 | Numajiri et al. . | |
| 5,505,648 | 4/1996 | Nagasawa et al. . | |
| 5,527,199 | 6/1996 | Feder et al. | 445/35 |

FOREIGN PATENT DOCUMENTS

| | | | |
|---|---|---|---|
| B0266821 | 1/1991 | European Pat. Off. . | |
| B0599581 | 4/1996 | European Pat. Off. . | |
| 833083 | 3/1952 | Germany . | |
| 579415 | 8/1946 | United Kingdom | 174/50.64 |

OTHER PUBLICATIONS

Patent Abstracts of Japan, vol. 6, Nr. 55 [E–101] 1982 for JP–A–56–168320 (Mitsubishi Denki K.K.).

*Primary Examiner*—Kenneth J. Ramsey
*Attorney, Agent, or Firm*—Sughrue, Mion, Zinn, Macpeak & Seas, PLLC

[57] ABSTRACT

The invention is directed to preventing occurrence of molybdenum foil breakage during a pinch sealing operation in a method of fabricating an arc tube having a pair of molybdenum foils pinch-sealed on both sides of a spherical portion of a glass tube by sequentially pinch-sealing the respective molybdenum foils. A first molybdenum foil is not pinch-sealed (first pinch seal) with an inert gas introduced into a glass tube as in a conventional embodiment, but is pinch-sealed with the internal pressure of the glass tube maintained at a vacuum of 0.5 torr or less. As a result, oxidation of the molybdenum foils causing breakage of the molybdenum foils during a pinch sealing operation is minimized. Hence, an arc tube having each of a pair of molybdenum foils made of molybdenum whose purity is 99.95% or more and with a thickness of 20 $\mu$m or less can be fabricated.

6 Claims, 5 Drawing Sheets

32
10
6
12
4a
4
24
26
28
36
38
34
22
40

32
10
6
12
4a
4
24
26
42
28
36
38
22

ARC TUBE HAVING A PAIR OF MOLYBDENUM FOILS, AND METHOD FOR ITS FABRICATION

FIELD OF THE INVENTION

The present invention relates to an arc tube used as a light source or the like in a discharge light and a method of fabricating such an arc tube.

BACKGROUND OF THE INVENTION

Since discharge lights can provide high luminance irradiation, these discharge lights are frequently used not only for outdoor lighting and roadway lighting, but also for motor vehicle headlights and interior lighting for stores or the like. As a light source, an arc tube such as that shown in FIG. 1(6) is known.

That is, arc tube 2 has a glass tube 4 having a spherical portion 4*a* formed in the middle thereof, and a pair of electrode assembly unit 6 arranged on both sides of the spherical portion 4*a* within the glass tube 4. Each electrode assembly unit 6 has both an electrode rod 8 that projects into an inner space of the spherical portion 4*a* (discharge chamber) and a lead wire 10 that projects from an end portion of the glass tube 4 connected thereto through a rectangular molybdenum foil 12, and is pinch-sealed to the glass tube 4 at the molybdenum foil 12 portion. By selecting the structure in which each molybdenum foil 12 is interposed between the electrode rod 8 and the lead wire 10 and the molybdenum foil 12 portions are pinch-sealed to the glass tube 4, a difference between the thermal expansion of a metal electrode made of a single member and that of the glass tube 4 when such metal electrode made of a single member is used can be absorbed by the thin film molybdenum foils 12, so that sealability within the spherical portion 4*a* can be maintained.

The term "pinch-seal" as used herein is intended to mean a sealing method in which an object to be inserted (such as a molybdenum foil) into the glass tube is embedded into the glass tube, with the object brought into intimate contact with the glass tube element by compressing the glass tube with a press while heated.

The aforementioned pair of molybdenum foils 12 are sequentially pinch-sealed on a single foil basis. Such pinch-seal operation for the first molybdenum foil has heretofore been performed in the following manner. As shown in FIG. 6, the electrode assembly unit 6 is inserted from one end portion of the glass tube 4 so that the molybdenum foil 12 is positioned close to the spherical portion 4*a* of the glass tube 4 (condition (a)), and under this condition, not only an inert gas such as argon gas or nitrogen gas is introduced into the glass tube 4 to thereby drive the air out of the glass tube 4, but also the portion of the glass tube 4 surrounding the molybdenum foil 12 is heated (condition (b)), and then, the glass tube 4 is pressed with a pincher 22 (condition (c)) to provide a pinch-sealed entity (condition (d)). This is how the molybdenum foil is pinch-sealed.

However, in the aforementioned conventional pinch sealing method, the following problems arise.

Since the tensile strength of a molybdenum foil is reduced when the molybdenum foil is oxidized, the molybdenum foil is susceptible to breakage during a pinch sealing operation. As a result, in the conventional pinch sealing method, the air that causes oxidation of the molybdenum foil is driven out of the glass tube 4 by introducing an inert gas into the glass tube. However, this method is not effective to adequately remove the air within the glass tube 4. As a result, the oxidation preventing effect of such a method is not enough either, causing quite a few molybdenum foil breakages.

In particular, in order to allow the molybdenum foils to absorb the difference between the thermal expansion coefficient of the molybdenum foil and that of the glass tube sufficiently, it is preferred that the thickness of each molybdenum foil be as thin as possible. However, if the thickness of the molybdenum foil is reduced to as thin as 20 $\mu$m or less, the problem of molybdenum breakage has often been encountered by the aforementioned conventional pinch sealing method.

On the other hand, if a molybdenum foil is formed by adding an additive such as potassium or calcium to molybdenum, the incidence of the aforementioned breakage can be reduced even if the thickness of the molybdenum foil is reduced to as thin as 20 $\mu$m or less. However, when such molybdenum foil having an additive mixed is used, the molybdenum foil becomes expensive, and the molybdenum foil is hard to machine with the hardness thereof increased.

SUMMARY OF THE INVENTION

The present invention has been made in view of the aforementioned circumstances. An object of the present invention is therefore to provide an arc tube having molybdenum foils whose breakages during a pinch sealing operation are prevented and which are inexpensive and whose machinability is satisfactory, as well as a method of fabricating such an arc tube.

The present invention is designed to achieve the above object by pinch-sealing a first molybdenum foil as follows. Unlike a conventional pinch sealing method that is implemented only with an inert gas introduced into the glass tube, the first molybdenum foil is pinch-sealed with the internal pressure of the glass tube maintained at a vacuum of 0.5 torr or less (or the internal pressure of the glass tube 4 is evacuated once to a vacuum of 0.5 torr or less, and then brought to and maintained at a pressure of 760 torr or less by sealing an inert gas into the glass tube 4).

That is, an arc tube according to the present invention is characterized in that, in an arc tube having a pair of molybdenum foils pinch-sealed on both sides of a spherical portion of a glass tube, each molybdenum foil is made of molybdenum whose purity is 99.95% or more, and the molybdenum foil has a thickness of 20 $\mu$m or less.

In order to obtain such an arc tube, an arc tube fabricating method of the present invention is characterized in that, in a method of fabricating an arc tube having a pair of molybdenum foils pinch-sealed on both sides of a spherical portion of a glass tube by sequentially pinch-sealing the respective molybdenum foils, a first molybdenum foil is pinch-sealed not only with the molybdenum foil inserted into a predetermined position in the glass tube, but also with the internal pressure of the glass tube maintained at a vacuum of 0.5 torr (or the internal pressure of the glass tube 4 is evacuated once to a vacuum of 0.5 torr or less, and then brought to and maintained at a pressure of 760 torr or less by sealing an inert gas into the glass tube 4).

DETAILED DESCRIPTION OF THE INVENTION

Figure 1:
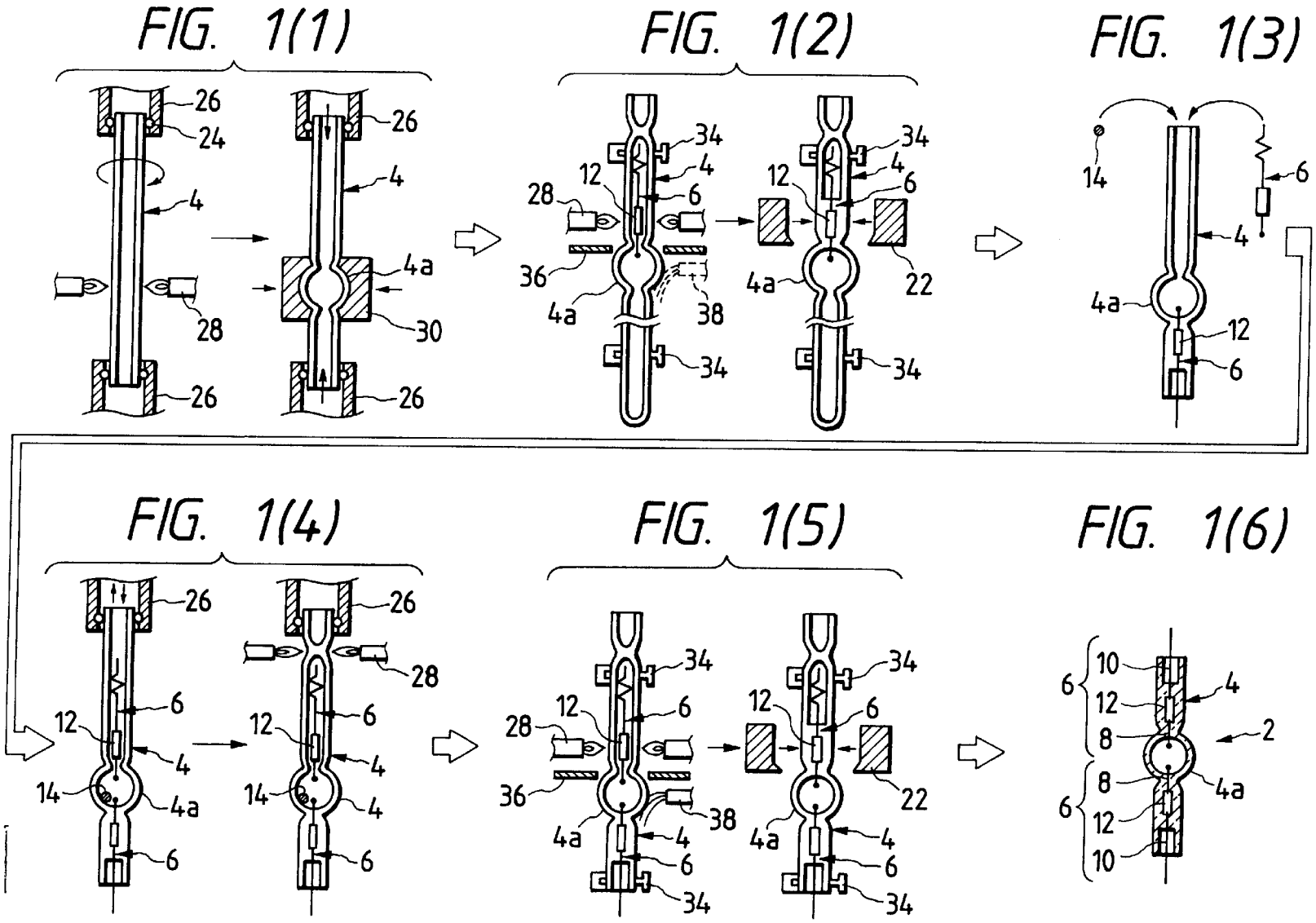
FIGS. 1(1) to 1(6) form a process diagram showing all the processes of a first embodiment of an arc tube fabricating method of the present invention.

In the present invention, the phrase "molybdenum whose purity is 99.95% or more" is intended to mean that the percentage of impurities (including additives) other than molybdenum is less than 0.05%.

While a specific method of bringing the internal pressure of the glass tube 4 to "a vacuum of 0.5 torr or less" is not particularly limited in the present invention, the following methods may be adopted. For example, a method of evacuating the glass tube from one end portion thereof with the other end portion thereof sealed ("sealing" is intended to mean that the other end portion of the glass tube is closed by heating) may be used, or a method of evacuating the glass tube from one end portion thereof with the other end portion thereof clogged with another member may be used.

In the method of fabricating an arc tube of the present invention, a first molybdenum foil is pinch-sealed not only with the molybdenum foil being inserted into a predetermined position within the glass tube but also with the internal pressure within the glass tube maintained at a vacuum of 0.5 torr or less (or with the internal pressure of the glass tube 4 evacuated once to a vacuum of 0.5 torr or less, and then brought to and maintained at a low pressure of 760 torr or less by sealing an inert gas into the glass tube 4). The predetermined position is defined, according to the present embodiment, at a position in the vicinity of the spherical portion 4*a* of the glass tube 4 where the molybdenum foil is located substantially at a center of the pinch-seald portion after it is pinch-sealed. Therefore, the oxygen concentration within the glass tube can be reduced to an extremely low level, which in turn contributes to minimizing oxidation of the molybdenum foils. Hence, even if a molybdenum foil which is made of molybdenum whose purity is 99.95% or more is used and whose thickness is reduced to as thin as 20 $\mu$m or less, breakage of the molybdenum foil during a pinch sealing operation can be prevented.

If the glass tube is made of quartz glass whose linear expansion coefficient is small, a difference between the thermal expansion coefficient of the molybdenum foil and that of the glass tube is further increased. Therefore, in such a case, it is more effective to adopt the arc tube fabricating method of the present invention.

Further, the arc tube according to the present invention is made of a pair of molybdenum foils, each being made of molybdenum whose purity is 99.95% or more and each having a thickness of 20 $\mu$m or less. The fact that such an arc tube has a pair of unbroken molybdenum foils means that such an arc tube is fabricated by the arc tube fabricating method of the present invention. In particular, when the glass tube of the arc tube is made of quartz glass, it is further apparent that such an arc tube cannot be obtained without adopting the arc tube fabricating method of the present invention.

Various embodiments of the present invention will now be described using the drawings.

A first embodiment will be described below.

FIG. 1 is a process diagram showing the total process of an arc tube fabricating method according to the first embodiment.

As shown in FIG. 1, an arc tube 2 is fabricated by five processes (1) to (5). A finished product (6) is obtained via these processes.

While the construction of the finished arc tube 2 has already been outlined in the section "Background of the Invention", the following will give further details. The arc tube 2 is designed so that a pair of leads 10 is connected to a power supply circuit (not shown). Therefore, when a high voltage is applied across a pair of electrode rods 8, discharge occurs between both electrode rods 8 to give off light. To permit such a discharge-induced light emission, xenon gas and chemicals such as mercury or metal halide are sealed within a spherical portion 4*a* of a glass tube 4. The arc tube 2, which is the object to be fabricated in the present embodiment, has a glass tube made of quartz glass, and molybdenum foils 12 made of pure molybdenum (whose purity is 99.95% or more) and having a thickness of 19 $\mu$m.

In FIG. 1, in the first glass molding process (1), the spherical portion 4*a* is formed first by heating the middle portion of the glass tube 4 with burners 28 while turning the glass tube 4 with both end portions of the glass tube 4 (still a cylindrical tube at this stage) hermetically supported by a pair of supply and discharge heads 26 to which O rings 24 are attached, respectively, and then by pushing dies 30 against the middle portion while blowing high-pressure air into the glass tube 4 from both supply and discharge heads 26.

Figures 2A, 2B, 2C, 2D, 2E, 2F, 2G:
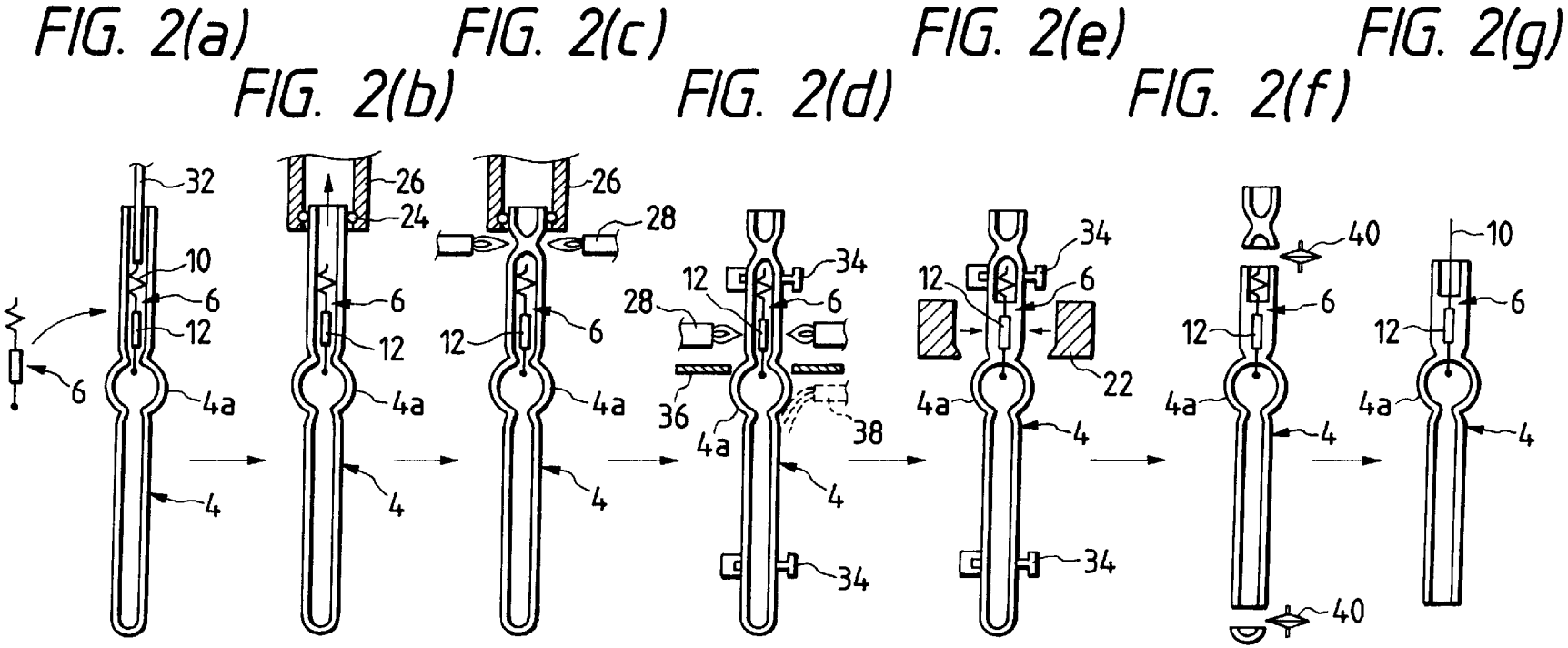
FIGS. 2(*a*) to 2(*g*) form a process diagram showing a first pinch sealing process of the aforementioned embodiment in detail.

In the first pinch sealing process (2), which is the second process, a first electrode assembly unit 6 is pinch-sealed in the glass tube 4. FIG. 2 is a process diagram showing this first pinch sealing process (2) in detail.

As shown in FIG. 2, the first pinch sealing process includes six processes (a) to (f).

More specifically, in the electrode assembly setting process (a), the glass tube 4 that has been through the glass molding process (1) is turned upside down and the lower opening end portion of the glass tube 4 is sealed, and the first electrode assembly unit 6 is thereafter inserted into the glass tube 4 using an insertion jig 32 from the upper opening end portion, so that a molybdenum foil 12 is positioned close to the spherical portion 4*a* of the glass tube 4. The lead 10 is bent zigzag for the electrode assembly unit 6 at this point to allow the electrode assembly unit 6 to be held at an arbitrary position within the glass tube 4 by causing the lead 10 to slide along the inner circumferential wall of the glass tube 4.

Then, in the evacuating process (b), the internal pressure of the glass tube 4 is evacuated to a vacuum of 0.5 torr or less by discharging the air within the glass tube 4 using a supply and discharge head 26 after the supply and discharge head 26 has been attached to the opening end portion of the glass tube 4 (or the internal pressure of the glass tube 4 is evacuated once to a vacuum of 0.5 torr or less, and then brought to a low pressure of 760 torr or less by sealing an inert gas into the glass tube 4). Then, in the sealing process (c), the glass tube 4 is sealed with the burners 28 close to the opening end portion with the aforementioned vacuum (or low pressure) condition maintained.

In the heating process (d), with the glass tube 4 chucked at two positions, upper and lower, using chucks 34, the portion surrounding the molybdenum foil 12 of the glass tube 4 is heated with the burners 28. Then, in the pinch sealing process (e), the portion of the glass tube 4 that has been softened by heating is pinch-sealed by pressing such portion in all directions with a pincher 22. In order not to allow the spherical portion 4*a* to be thermally deformed during heating, not only is a heat shielding plate 36 interposed between the burners 28 and the spherical portion 4*a*, but also liquid nitrogen is purged from a nozzle 38 arranged below the shielding plate 36 to cool the spherical portion 4*a*. It may be noted that such cooling by the purging of liquid nitrogen is not necessary if the shielding effect of the heat shielding plate 36 is adequate.

As the last step, in the glass cutting process (f), unnecessary portions on both the upper and lower end portions of the glass tube 4 are cut by cutters 40. As a result, the first pinch sealing process (2) is completed.

In FIG. 1, in the sealed substance supplying process (3), after the glass tube 4 that has been through the first pinch sealing process (2) has been turned upside down, not only chemicals 14 are supplied into the spherical portion 4*a* from the not yet pinch-sealed upper opening end portion of the glass tube 4, but also the second electrode assembly unit 6 is inserted into the glass tube 4 to thereby position a molybdenum foil 12 close to the spherical portion 4*a* within the glass tube 4.

Then, in the starting gas sealing and temporary sealing process (4), after not only the air within the glass tube 4 has been discharged with the supply and discharge head 26 being attached to the opening end portion of the glass tube 4, but also xenon gas has been sealed within the glass tube 4, the glass tube 4 is sealed with the burners 28 close to the opening end portion.

In the second pinch sealing process (5), the second electrode assembly unit 6 is pinch-sealed in the glass tube 4. More specifically, the portion surrounding the molybdenum foil 12 of the glass tube 4 is heated using the burners 28 with the glass tube 4 chucked by the chucks 34 at two positions, upper and lower. Then, the portion of the glass tube 4 that has been softened by heating is pinch-sealed by pressing such portion in all directions with the pincher 22. In order not to allow the spherical portion 4*a* to be thermally deformed during heating operation, not only is the heat shielding plate 36 interposed between the burners 28 and the spherical portion 4*a*, but also liquid nitrogen is purged from the nozzle 38 arranged below the shielding plate 36 to cool the spherical portion 4*a*. It may be noted that, unlike in the first pinch sealing process (2), even if the shielding effect of the heat shielding plate 36 is adequate, such cooling by the purging of liquid nitrogen should be used in order to prevent breakage of the glass tube 4 due to expansion of the xenon gas that has been sealed in the glass tube 4.

Unnecessary portions on the upper part of the glass tube 4 to which both electrode assembly units 6 have been pinch-sealed in the aforementioned way are cut. As a result, a finished product of the arc tube 2 shown in (6) can be obtained.

As described above in detail, in the arc tube fabricating method according to the present embodiment, the first electrode assembly unit 6 is pinch-sealed not only with the molybdenum foil 12 inserted into a predetermined position within the glass tube 4 but also with the internal pressure of the glass tube 4 maintained at a vacuum of 0.5 torr or less (or the internal pressure of the glass tube 4 brought once to a vacuum of 0.5 torr or less, and thereafter brought to and maintained at a low pressure of 760 torr or less by sealing an inert gas into the glass tube 4). Therefore, the oxygen concentration within the glass tube 4 can be reduced to an extremely low level, which in turn contributes to minimizing oxidation of the molybdenum foil 12.

As a result, despite the fact that the molybdenum foil 12 of the arc tube 2 that is the object to be fabricated in the present embodiment is made of pure molybdenum whose thickness is 19 $\mu$m and that the glass tube 4 is made of quartz glass whose coefficient of linear expansion is small (such that the difference between the thermal expansion of the glass tube 4 and that of the molybdenum foil 12 is extremely large), breakage of the molybdenum foil 12 can be prevented during a pinch sealing operation.

Figure 3:
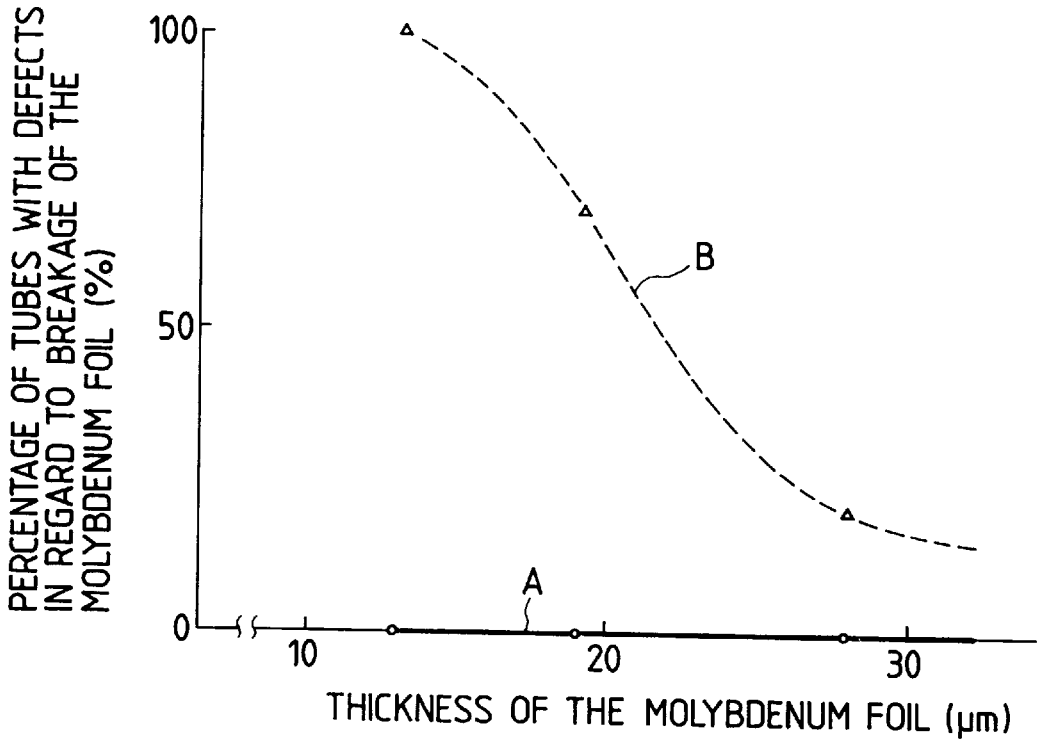
FIG. 3 is a graph showing a function of the aforementioned embodiment in comparison with a conventional embodiment.

FIG. 3 is a graph showing the result of an experiment conducted to check the fraction of tubes which were defective in regard to breakage of the molybdenum foil 12 during the pinch sealing operation in relation to the thickness of the molybdenum foil 12.

When the pinch sealing operation is performed with an inert gas introduced into the glass tube 4 as in the conventional embodiment, the percent defective is increased radically with decreasing thickness of the molybdenum foil 12 as indicated by the broken line B, allowing the percent defective to exceed 50% at a thickness of 20 $\mu$m or less. On the other hand, in the case where the pinch sealing operation is performed with the internal pressure of the glass tube 4 maintained at a vacuum (or at a low pressure by sealing an inert gas into the glass tube 4 after the glass tube 4 has been brought into the vacuum) as in the present embodiment, the percent defective remains at a level of 0% even if the thickness of the molybdenum foil 12 is reduced to 20 $\mu$m or less as indicated by the solid line A.

The reason why it is designed so that the internal pressure of the glass tube 4 is maintained at a vacuum of 0.5 torr or less (or the internal pressure of the glass tube 4 evacuated once to a vacuum of 0.5 torr or less, and thereafter brought to and maintained at a low pressure of 760 torr or less by sealing an inert gas into the glass tube 4) in the present embodiment is as follows. As shown in Table 1, according to an experiment conducted to check the fraction defective regarding breakage of the molybdenum foil 12 during a pinch sealing operation with the thickness of the molybdenum foil 12 set to 20 $\mu$m, foil breakage disappeared at a vacuum of 0.5 torr or less.

TABLE 1

Condition of breakage of molybdenum foil during pinch sealing operation

| Vacuum (Torr) | 1 | 0.8 | 0.5 | 0.1 | 0.01 | 0.001 |
|---|---|---|---|---|---|---|
| Foil breakage | x | x | ○ | ○ | ○ | ○ |

Legend:
○: No foil breakage
x: Foil breakage occurred
(Thickness of molybdenum foil: 20 $\mu$m)

Further, according to the present embodiment, not only oxidation of the molybdenum foil 12 but also oxidation of the electrode rod 8 can be minimized. As a result, the following unsatisfactory condition encountered in the conventional embodiment can be prevented effectively. That is, in the conventional embodiment, free oxygen toward the spherical portion 4*a* of the arc tube 2 from the oxides remaining on the surface of the electrode rod 8 reacts with mercury or metal halide within the spherical portion 4*a* to thereby break the equilibrium of reaction that should exist within the spherical portion 4*a* and blacken or devitrify the spherical portion 4*a*. Such an unsatisfactory condition can be prevented effectively. Hence, life performance (especially the lumen maintenance factor) can be improved.

Figure 4:
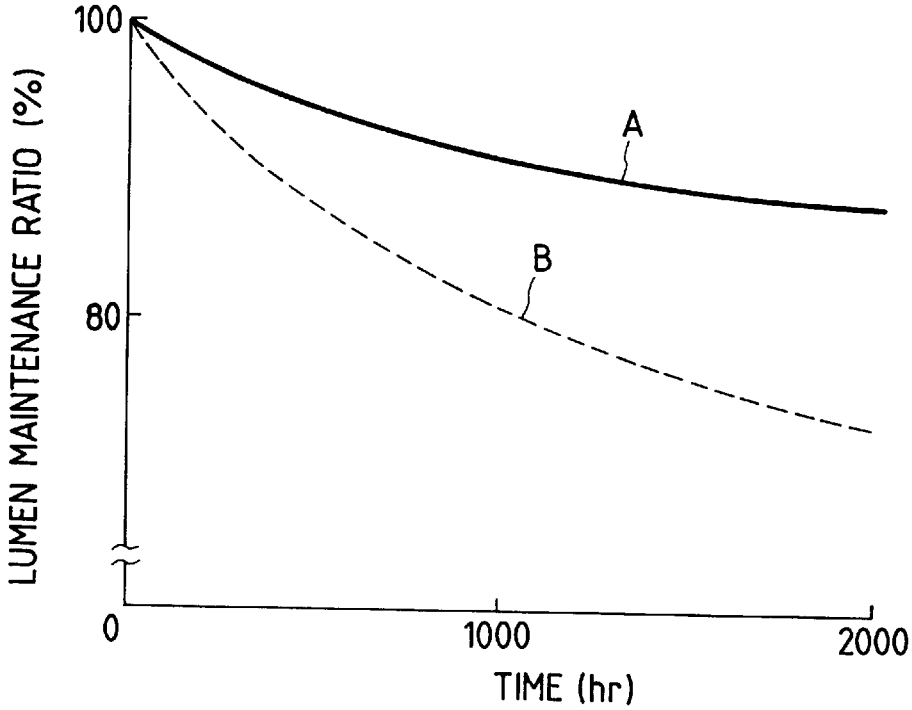
FIG. 4 is a graph showing a function of an arc tube fabricated by the aforementioned embodiment in comparison with the conventional embodiment.

FIG. 4 is a graph showing the result of an experiment conducted to check the lumen maintenance factor when the arc tube 2 is continuously lit.

When the pinch sealing operation is performed with an inert gas introduced into the glass tube 4 as in the conventional embodiment, a reduction in the lumen maintenance factor is so grave that the lumen maintenance factor is reduced to about 80% after 1000 hours has elapsed, as indicated by the broken line B. On the other hand, in the case where the pinch sealing operation is performed with the internal pressure of the glass tube 4 maintained at a vacuum as in the present embodiment, a reduction in the lumen maintenance factor is mild, allowing the lumen maintenance factor to remain at a level of 90% even after 2000 hours has elapsed, as indicated by the solid line A.

A second embodiment of the present invention will be described below.

The present embodiment is distinguished from the first embodiment shown in FIG. 1 only in the first pinch sealing process (2) out of all the processes.

Figures 5A, 5B, 5C, 5D, 5E:
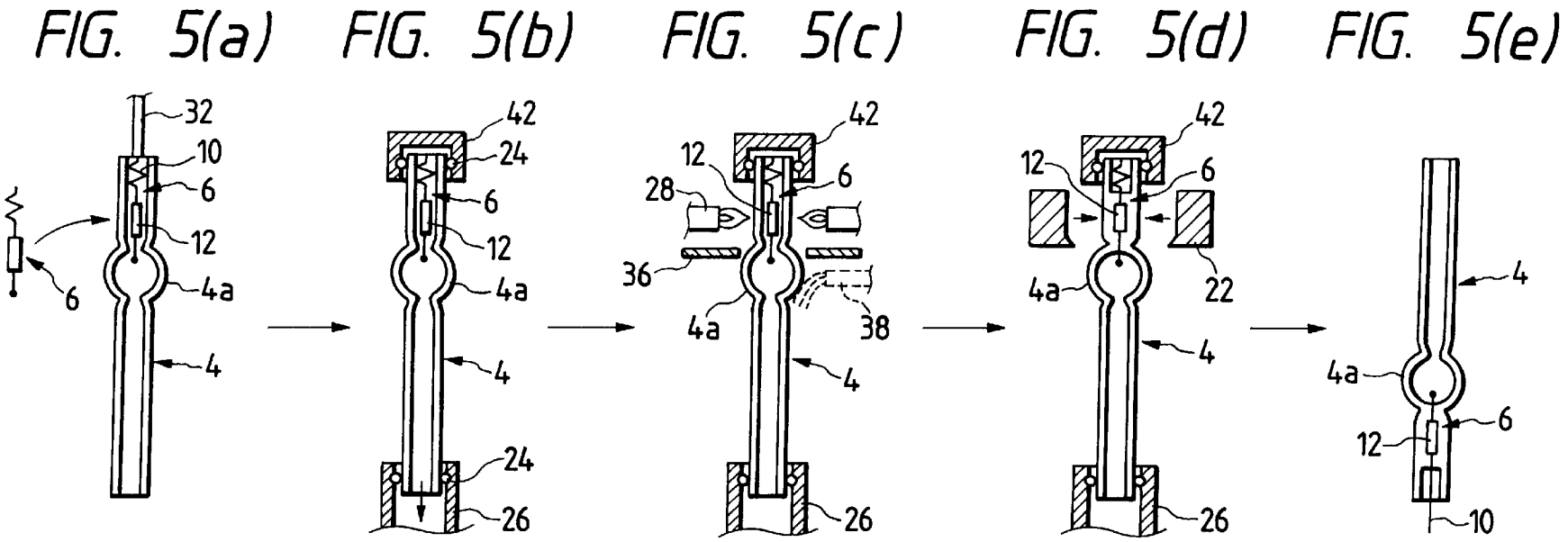
FIGS. 5(*a*) to 5(*e*) form a process diagram showing a first pinch sealing process in a second embodiment of an arc tube fabricating method of the present invention in detail.
Figure 6A:
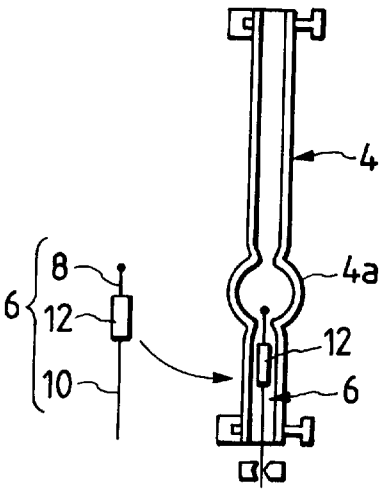
FIGS. 6(*a*) to 6(*d*) form a diagram similar to FIG. 2 showing the conventional embodiment.
Figure 6B:
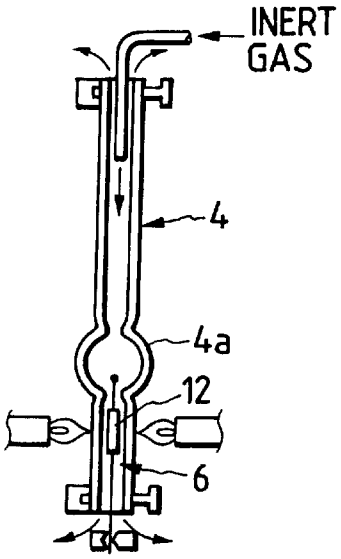
Figure 6C:
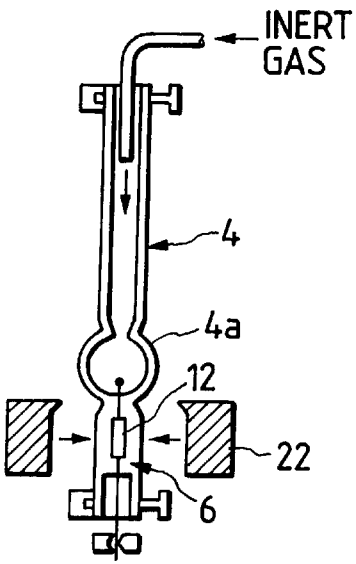
Figure 6D:
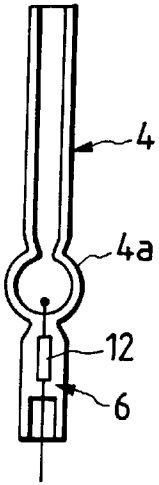

FIG. 5 is a process diagram showing the first pinch sealing process (2) in the present embodiment. As shown in FIG. 5, the first pinch sealing process includes four processes (a) to (d).

More specifically, in the electrode assembly setting process (a), after the glass tube 4 that has been through the glass molding process (1) has been turned upside down and the lower opening end portion of the glass tube 4 has been sealed, a first electrode assembly unit 6 is inserted into the glass tube 4 using the insertion jig 32 from the upper opening end portion, so that a molybdenum foil 12 is positioned close to the spherical portion 4*a* of the glass tube 4.

Then, in the discharge process (b), not only is a clogging cap 42 attached to the upper opening end portion of the glass tube 4, but also the supply and discharge head 26 is attached to the lower opening end portion of the glass tube 4, and the internal pressure of the glass tube 4 is thereafter evacuated to a vacuum of 0.5 torr or less by discharging the air from the glass tube 4 using the supply and discharge head 26 after the supply and discharge head 26 has been attached to the opening end portion of the glass tube 4 (or the internal pressure of the glass tube 4 is evacuated once to a vacuum of 0.5 torr or less, and thereafter brought to and maintained at a low pressure of 760 torr or less by sealing an inert gas into the glass tube 4). It may be noted that an O ring 24 is also attached to the clogging cap 42 in order to ensure sealability.

Then, in the heating process (c), the portion of the glass tube 4 surrounding the molybdenum foil 12 is heated with the burners 28, and then in the pinch sealing process (d), the portion of the glass tube 4 that has been softened by heating is pinch-sealed by pressing such portion in all directions with the pincher 22. In a manner similar to the first embodiment, the heat shielding plate 36 is interposed and liquid nitrogen is purged from the nozzle 38 as necessary during heating.

As the last step, the clogging cap 42 and the supply and discharge head 26 are removed from the glass tube 4, so that the first pinch sealing process (2) is completed.

Also in the present embodiment, similarly to the first embodiment, the first electrode assembly unit 6 is pinch-sealed not only with the molybdenum foil 12 of the first electrode assembly unit 6 inserted into a predetermined position in the glass tube 4, but also with the internal pressure of the glass tube 4 maintained at a vacuum of 0.5 torr or less (or with the internal pressure of the glass tube 4 evacuated once to a vacuum of 0.5 torr or less, and thereafter brought to and maintained at a low pressure of 760 torr or less by sealing an inert gas into the glass tube 4). Therefore, the oxygen concentration within the glass tube 4 can be reduced to an extremely low level, which in turn contributes to minimizing oxidation of the molybdenum foil 12.

Further, in the present embodiment, the use of the clogging cap 42 in the first pinch sealing process (2) makes it unnecessary to seal both end portions of the glass tube 4 in order to create a vacuum in the glass tube 4 as in the first embodiment. Therefore, the sealing operation and the operation of cutting both end portions of the sealed glass tube 4 can be dispensed with, which in turn contributes to simplifying the first pinch sealing process (2).

While the invention has been described in detail and with reference to specific embodiments thereof, it will be apparent to one of ordinary skill in the art that various changes and modifications can be made therein without departing from the spirit and scope thereof.

What is claimed is:

1. An arc tube having a pair of molybdenum foils pinch-sealed on both sides of a spherical portion of a glass tube, wherein each molybdenum foil is made of molybdenum whose purity is 99.95% or more, each molybdenum foil has an electrode rod attached thereto, and each molybdenum foil has a thickness of 20 $\mu$m or less;

wherein the arc tube is fabricated by a method comprising sequentially pinch-sealing the molybdenum foils, wherein a first molybdenum foil is pinch-sealed not only after being inserted into a predetermined position in the glass tube, but also with the glass tube having an internal pressure maintained at a vacuum of 0.5 torr or less.

2. An arc tube according to claim 1, wherein the glass tube is made of quartz glass.

3. A method of fabricating an arc tube which has a pair of molybdenum foils pinch-sealed on both sides of a spherical portion of a glass tube, wherein the method comprises sequentially pinch-sealing the molybdenum foils, wherein a first molybdenum foil is pinch-sealed not only after being inserted into a predetermined position in the glass tube, but also with the glass tube having an internal pressure maintained at a vacuum of 0.5 torr or less.

4. A method of fabricating an arc tube which has a pair of molybdenum foils pinch-sealed on both sides of a spherical portion of a glass tube, wherein the method comprises sequentially pinch-sealing the molybdenum foils, wherein a first molybdenum foil is pinch-sealed not only after being inserted into a predetermined position in the glass tube, but also with the glass tube having an internal pressure maintained at 760 torr by sealing an inert gas after the glass tube has been evacuated once to a vacuum of 0.5 torr or less.

5. A method of fabricating an arc tube according to claim 3, wherein the glass tube is made of quartz glass.

6. A method of fabricating an arc tube according to claim 4, wherein the glass tube is made of quartz glass.

* * * * *